US007504782B2

(12) United States Patent
Hasegawa et al.

(10) Patent No.: US 7,504,782 B2
(45) Date of Patent: Mar. 17, 2009

(54) DISCHARGE LAMP LIGHTING APPARATUS AND PROJECTOR

(75) Inventors: Junichi Hasegawa, Neyagawa (JP); Hirofumi Konishi, Hirakata (JP); Akihiro Kishimoto, Osaka (JP); Koji Watanabe, Kadoma (JP); Katsuyoshi Nakada, Katano (JP)

(73) Assignee: Panasonic Electric Works Co., Ltd., Osaka (JP)

( * ) Notice: Subject to any disclaimer, the term of this patent is extended or adjusted under 35 U.S.C. 154(b) by 82 days.

(21) Appl. No.: 11/570,054

(22) PCT Filed: Mar. 22, 2005

(86) PCT No.: PCT/JP2005/005141

§ 371 (c)(1),
(2), (4) Date: Feb. 9, 2007

(87) PCT Pub. No.: WO2005/122652

PCT Pub. Date: Dec. 22, 2005

(65) Prior Publication Data

US 2008/0048586 A1 Feb. 28, 2008

(30) Foreign Application Priority Data

Jun. 10, 2004 (JP) ..... 2004-173154

(51) Int. Cl.
*H05B 37/02* (2006.01)

(52) U.S. Cl. ..... 315/307; 315/247; 315/308

(58) Field of Classification Search ..... 315/209 R, 315/224–226, 246–247, 291, 307–308, DIG. 7
See application file for complete search history.

(56) References Cited

U.S. PATENT DOCUMENTS 5,444,336 A * 8/1995 Ozawa et al. ..... 315/307
5,914,572 A * 6/1999 Qian et al. ..... 315/307
6,023,132 A * 2/2000 Crouse et al. ..... 315/307

(Continued)

FOREIGN PATENT DOCUMENTS

JP 5-21175 1/1993

(Continued)

OTHER PUBLICATIONS

English language Abstract of JP 2003-31394.

(Continued)

*Primary Examiner*—David Hung Vu
*Assistant Examiner*—Tung X Le
(74) *Attorney, Agent, or Firm*—Greenblum & Bernstein, P.L.C.

(57) ABSTRACT

A discharge lamp lighting apparatus comprising a d.c. power source section which rectifies and smoothes an a.c. voltage; a current detecting circuit which detects a current which flows through a discharge lamp; a power source ripple detecting circuit which detects a voltage change of power supplied from the d.c. power source section and outputs a voltage obtained by superimposing the detected voltage over a detected voltage which is available from the current detecting circuit; and a control circuit which controls, based on the output voltage from the power source ripple detecting circuit, an output voltage to the discharge lamp so that the current flowing through the discharge lamp becomes a constant current. A rate of superimposition of the output voltage from the power source ripple detecting circuit may be switched in accordance with the discharge lamp voltage.

18 Claims, 11 Drawing Sheets

U.S. PATENT DOCUMENTS

| | | | | |
|---|---|---|---|---|
| 6,225,754 | B1 * | 5/2001 | Horiuchi et al. | 315/246 |
| 6,232,725 | B1 | 5/2001 | Derra et al. | |
| 2002/0047643 | A1 | 4/2002 | Takahashi et al. | |
| 2004/0113567 | A1 * | 6/2004 | Yamauchi et al. | 315/291 |
| 2006/0055341 | A1 * | 3/2006 | Watanabe et al. | 315/291 |
| 2006/0158131 | A1 * | 7/2006 | Mitsuyasu et al. | 315/209 R |
| 2006/0164842 | A1 | 7/2006 | Goriki et al. | |

FOREIGN PATENT DOCUMENTS

| | | |
|---|---|---|
| JP | 2002-532866 | 10/2002 |
| JP | 2003-31394 | 1/2003 |
| WO | 00/36882 | 6/2000 |

OTHER PUBLICATIONS

English language Abstract of JP 5-21175.
English language Abstract of JP 2002-532866.
English language Abstract of JP 2002-134287

* cited by examiner

3
E
1
2
BOOSTER CHOPPER
C1
9
R2
R3
Vdc
4
Q1
D1
L1
5
R1
6
INVERTER
7
Vla
R4
R5
La
ILa
8
84
PWM CONTROL C.
85
V.A.C
CURRENT DETECT VOLTAGE
REFERENCE VOLTAGE
C3
C2
R7
R6
PWM SIGNAL
PWM SIGNAL
80
81
A/D
83
CONTROLLER
82
DATA TABLE
POWER CONTROL DATA Px
X0
X1
X1023
R.S.DATA Vxx
XX0
XX1
XX1023
POWER CONTROL DATA Py
Y0
Y1
Y1023
R.S.DATA Vyy
YY0
YY1
YY1023
LAMP V
0
1
1023

DISCHARGE LAMP LIGHTING APPARATUS AND PROJECTOR

TECHNICAL FIELD

The present invention relates to a discharge lamp lighting apparatus which uses, as a lighting power source, a power source which rectifies and smoothes commercial a.c. power and more particularly, to a technique for controlling a discharge lamp current constant

BACKGROUND ART

The recent years have seen a rapid expansion of a projectors market and a further market growth is expected. However, to win in the growing market how to deal with a flicker of light from a lamp is becoming an important issue. Brightness has been one of criteria for determining whether a light source for a projector has a superior capability, and a high-pressure mercury-arc lamp developed noting this has a shortest possible arc length and resembles as much as possible a point light source in an effort to enhance the luminance. This gives rise as a side effect to a problem that depending upon the temperature of an electrode of the high-pressure discharge lamp and the condition of a surface of the electrode which is near an arc, a discharge arc develops at an instable location on the electrode and to a phenomenon that the origin of a discharge arc moves from one point to another on the electrode. This phenomenon is visible as a flicker of lamp light (a lamp flicker), and the lamination on a screen irradiated from a projector decreases, which is a major problem in terms also of maintenance of the lamination.

FIG. 13 is a circuitry diagram of a conventional discharge lamp lighting apparatus. The discharge lamp lighting apparatus shown in FIG. 13 includes a d.c. power source section 3 which outputs d.c. voltage Vdc which is obtained by rectifying and smoothing a voltage from a commercial a.c. power source E, a step-down chopper circuit 4 which is connected with an output terminal of the power source section and which provides power control of a discharge lamp La, an invertor circuit 6 which inverts the polarity of a voltage of tile discharge lamp La at a low frequency and which lights up the lamp with a rectangale wave, a discharge lamp current detecting circuit 5 which is formed by a discharge lamp current detecting resistor R1, a discharge lamp voltage detecting circuit 7 which is formed by discharge lamp voltage detecting resistors R4 and R5, and a control circuit block 8 which provides power control.

The discharge lamp voltage detected by the discharge lamp voltage detecting circuit 7 is fed to an A/D conversion input port of a microcomputer 80 which is disposed within the control circuit block 8, and converted into a digital value by a built-in A/D convertor 81. A controller 83 refers to a data table 82, reads power control data Px (X0, X1, . . . , X1023) corresponding to lamp voltage data (0, 1, . . . , 1023) converted into a digital value, and outputs this as a PWM signal. A CR integrating circuit formed by a resistor R6 and a capacitor C2 averages out the PWM signal and transmits this to a PWM control circuit 84 as a reference voltage (command value). The step-down chopper circuit 4 provides the discharge lamp La with electric power which corresponds to an output from the PWM control circuit 84.

An operation of the discharge lamp lighting apparatus shown in FIG. 13 will now be described. FIG. 14 shows the waveform of the d.c. voltage Vdc which is output from the d.c. power source section 3. FIG. 15 shows a discharge lamp current detect voltage and the reference voltage at points A, B and C on the d.c. voltage Vdc. FIG. 16 shows a current IQ1 which flows in a switching element Q1 at the points A, B and C on the d.c. voltage Vdc.

The PWM control circuit 84 detects the current 1Q1 which flows in the switching element Q1 as a voltage across the resistor R1, and when the voltage thus detected exceeds the reference voltage turns off the switching element Q1. Upon turning off of the switching element Q1, a regenerative current of a chopper inductor L1 flows through a diode D1. Owing to a current detected in the diode D1 or a secondary coil output from the inductor L1, the PWM control circuit 84 turns on the switching element Q1 once again upon detection of a zero crossing point of the regenerative current or in accordance with the timing given by an oscillator circuit which is disposed inside the PWM control circuit 84. In this manner, the discharge lamp current is controlled into a current which corresponds to the reference voltage.

However, the d.c, voltage Vdc which is output from the d.c. power source section 3, although smoothed out by the capacitor C1, varies within a range of a few volts to scores of volts (hereinafter referred to as "a ripple") as shown in FIG. 14. For instance, when the frequency of the commercial a.c. power source is 60 Hz, the ripple frequency of the power source is approximately 120 Hz. In addition, as shown in FIG. 15, the detect voltage becomes slightly higher than the reference voltage because of a delays time t1 (which is from a few ns to a few hundred ns) in the response speed of the PWM control circuit 84 which is disposed inside the control circuit block 8. The excess of the detect voltage at the point A is ΔVA1 over the detect voltage as it is at the point B, and at the point C on the contrary), the detect voltage becomes lower by ΔVC1 than at the point B as shown in FIG. 15. The current IQ1 which flows in the switching element Q1 within the step-down chopper circuit 4 therefore is as shown in FIG. 16 at the respective points A, B and C. This can be explained by the formula IQ1 (peak value)=(Vdc−Vla)×(ON-time of Q1)/L. The symbol Vla denotes the discharge lamp voltage at that time, while the symbol L denotes the inductance value of the inductor L1 inside the step-down chopper circuit 4.

When the discharge lamp La is constant (stably lit), the inductance value L is constant, and therefore, a change of the d.c. voltage Vdc changes the ingredient of the current IQ1 which flows in the switching element Q1. Hence, as shown in FIG. 16, the current IQ1 at the point A becomes higher by ΔIA than at the point B but lower at the point C by ΔIC than at the point B. In consequence, a current ILa flowing through the discharge lamp La is a current which has ripples which are in the same phase as that of Vdc, which causes a control-induced lamp flicker.

Japanese Translation of PCT Internal Application No. 2002-532866, and Japanese Patent Application Laid-Open Gazette No. 2002-134287 disclose a means which reduces a lamp flicker against deterioration of an electrode of a lamp where a method of lighting up with a rectangle wave is used. However, such a means alone can not solve the problem of a control-induced lamp flicker which arises in a discharge lamp lighting circuit itself.

DISCLOSURE OF INVENTION

The present invention has been made to solve the problem above, and accordingly, an object of the present invention is to provide a discharge lamp lighting apparatus which uses, as a lighting powers source, a power source section which rectifies and smoothies commercial a.c. power, and which is capable of suppressing a flicker. A further object of the present invention is to provide a projector which uses such a discharge lamp lighting apparatus.

In a first aspect of the prevent invention, a discharge lamp lighting apparatus includes: a d.c. power source section which rectifies and smoothes an a.c. voltage and outputs a d.c. voltage; a current detecting circuit which detects a current which flows through the discharge lamp; a power source ripple detecting circuit which detects a voltage change of power supplied from the d.c. power source section and outputs a voltage which is obtained by superimposing thus detected voltage over a detected voltage which is available from the current detecting circuit; and a control circuit which controls an output voltage to the discharge lamp so that the current flowing through the discharge lamp becomes a constant current, based on the output voltage from the power source ripple detecting circuit.

In a second aspect of the prevent invention, a discharge lamp lighting apparatus includes: a d.c power source section which rectifies and smoothes an a.c. voltage and outputs a d.c. voltage; a voltage detecting circuit which detects a voltage applied upon the discharge lamp; a power source ripple detecting circuit which detects a voltage change of power supplied from the d.c. power source section; and a control circuit which superimposes an output voltage from the power source ripple detecting circuit over a reference voltage generated based on the voltage detected by the voltage detecting circuit, and controls an output voltage to the discharge lamp so that a current flowing through the discharge lamp becomes a constant current, based on thus superimposed voltage.

According to the prevent invention, in the discharge lamp lighting apparatus which uses, as a lighting power source, a power source section which rectifies and smoothes commercial a.c. power, a voltage ripple in power supplied from this power source section is detected and control is implemented so that a discharge lamp current becomes a constant current, which in turn reduces a ripple in the discharge lamp current and suppresses a flicker.

BEST MODE FOR CARRYING OUT THE INVENTION

First Embodiment

Figure 1:
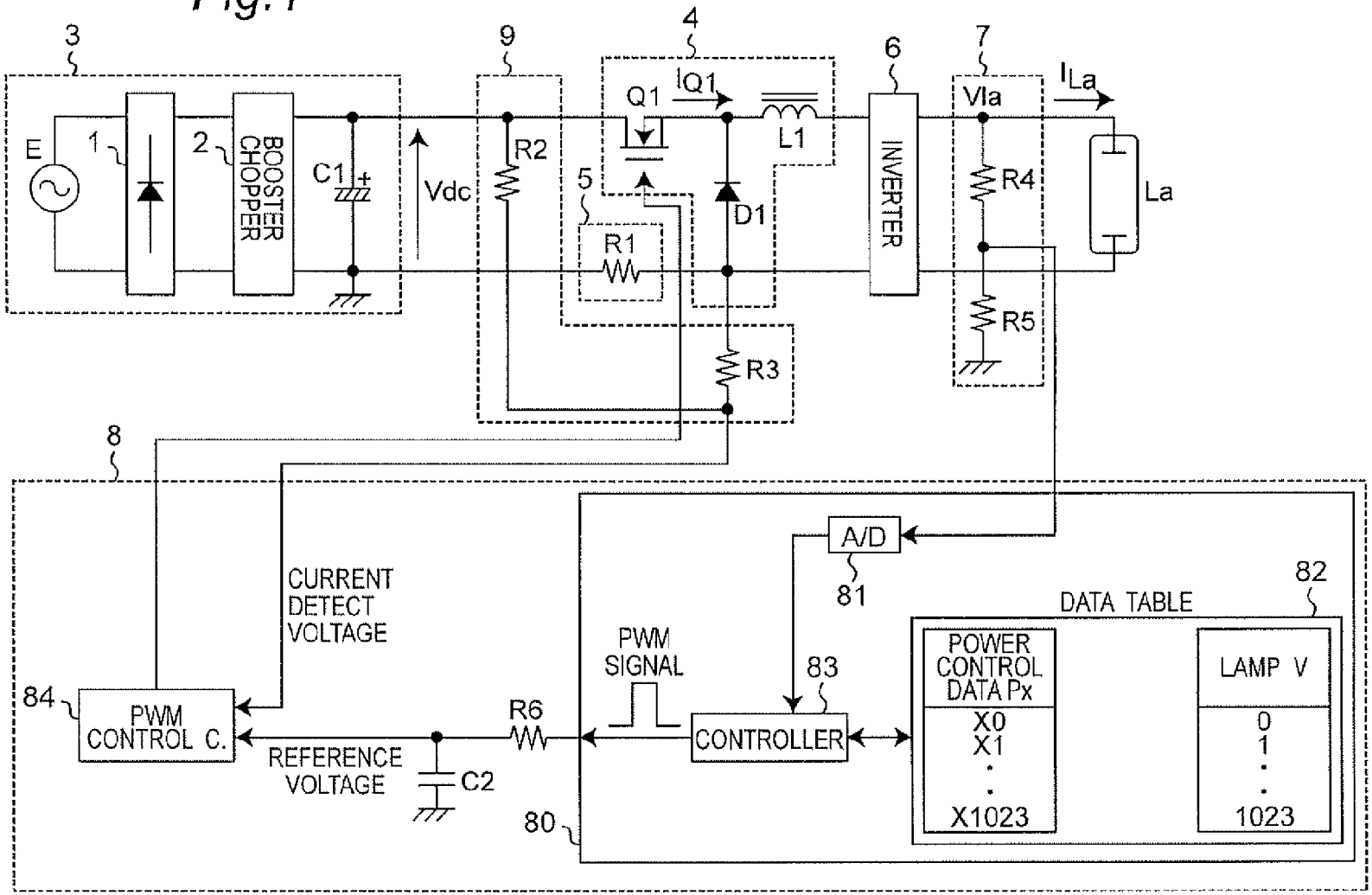
FIG. 1 is a circuitry diagram which shows a first embodiment of the present invention.

FIG. 1 is a circuitry diagram which shows the first embodiment of the present invention. The discharge lamp lighting apparatus shown in FIG. 1 includes a d.c. power source section 3 which outputs a d.c. voltage Vdc which is obtained by rectifying and smoothing a voltage from a commercial a.c. power source E, a step-down chopper circuit 4 which is connected with an output terminal of the power source section 3 and which provides power control of a discharge lamp La, a discharge lamp current detecting circuit 5 which detects a current flowing through the discharge lamp La, an invertor circuit 6 which inverts the polarity of a voltage of the discharge lamp La at a low frequency and which accordingly lights up the lamp with a rectangle wave, a discharge lamp voltage detecting circuit 7 which detects a voltage applied upon the discharge lamp La, a control circuit block 8 which provides power control, and a power source ripple detecting circuit 9 which is formed by power source ripple detecting resistors R2 and R3.

The d.c. power source section 3 includes a diode bridge circuit 1 which is connected with the commercial a.c. power source E, a booster chopper circuit 2, and a smoothing capacitor C1. The step-down chopper circuit 4 includes a switching element Q1, an inductor L1 and a diode D1. The discharge lamp current detecting circuit 5 is formed by a discharge lamp current detecting resistor R1. The discharge lamp voltage detecting circuit 7 is formed by voltage detecting resistors R4 and R5.

The control circuit block 8 includes a PWM control circuit 84 which controls the switching element Q1 of the step-down chopper circuit 4, and a microcomputer 80 which outputs a PWM signal to the PWM control circuit 84 in accordance with an output from the discharge lamp voltage detecting circuit 7. The microcomputer 80 includes an A/D convertor 81, a data table 82 and a controller 83. The microcomputer 80 may be formed by an 8-bit microcomputer M37540 manufactured by Mitsubishi Electric Corporation for instance (which applies to the later embodiments as well). The power source ripple detecting circuit 9 detects a power source ripple component of the d.c. voltage Vdc which is output from the d.c. power source section 3 and superimposes this power source ripple component over a discharge lamp current detect voltage which is detected by the discharge lamp current detecting circuit 5.

The discharge lamp detect voltage which is detected by the discharge lamp voltage detecting circuit 7 is fed to an A/D conversion input port of the microcomputer 80 which is disposed within the control circuit block 8, and converted into a digital value by the A/D convertor 81. The controller 83 refers to the data table 82, reads power control data Px (X0, X11, . . . , X1023) corresponding to lamp voltage data (0, 1, . . . , 1023) converted into a digital value and outputs this as the PWM signal (which is a rectangle wave signal whose cycle is constant but whose ON-period is variable). A CR integrating circuit formed by a resistor R6 and a capacitor C2 averages out the PWM signal and transmits this to the PWM control circuit 84 as a reference voltage (command value).

The PWM control circuit 84 outputs a control signal to the step-down chopper circuit based on the detect voltage and the reference voltage. In short, the PWM control circuit 84 receives the detect voltage from the power source ripple detecting circuit 9 and the reference voltage from the microcomputer 80, and when the detect voltage exceeds the reference voltage, turns off the switching element Q1. As the switching element Q1 turns off, a regenerative current developing in the chopper inductor L1 flows through the diode D1. Owing to the detect voltage from the power source ripple detecting circuit 9 or a secondary coil output from the inductor L1, the PWM control circuit 84 turns on the switching element Q1 once again upon detection of a zero crossing point of the regenerative current or in accordance with the timing given by an oscillator circuit which is disposed inside the PWM control circuit 84.

The step-down chopper circuit 4 provides the discharge lamp La with power which corresponds to the control signal from the PWM control circuit 84.

Although the example above relates to use of the microcomputer 80 equipped with the data table 82 as a means which generates the reference voltage for the PWM control circuit 84 in accordance with the value detected as a lamp voltage Vla, this is not limiting. Any other means may be used instead to the extent that the means is capable of setting a target value of lamp power in accordance with a detected lamp voltage value and outputting as the reference voltage a target lamp current value for realization of this lamp power. While the discharge lamp lighting apparatus requires an igniter circuit which applies a high-voltage pulse at the start-up of the discharge lamp La, the igniter circuit is omitted in the drawing.

Figure 2:
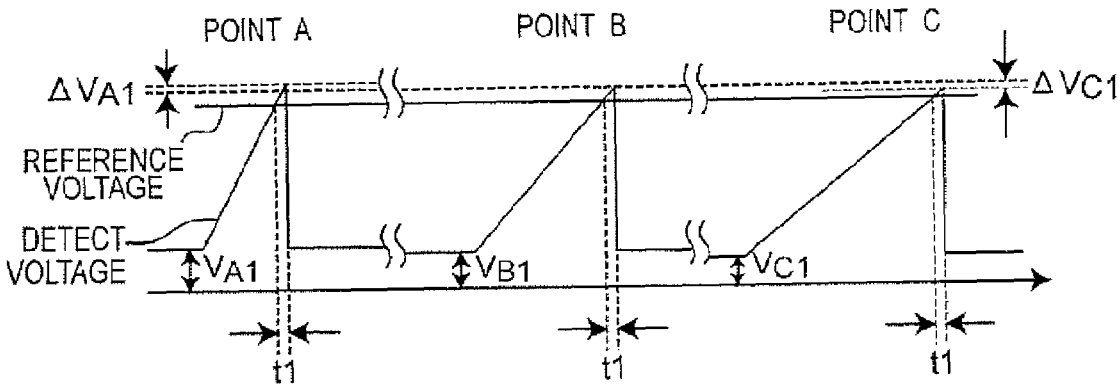
FIG. 2 is a waveform diagram which shows the waveform of a discharge lamp current detect voltage and that of a reference voltage in the first embodiment of the present invention.
Figure 3:
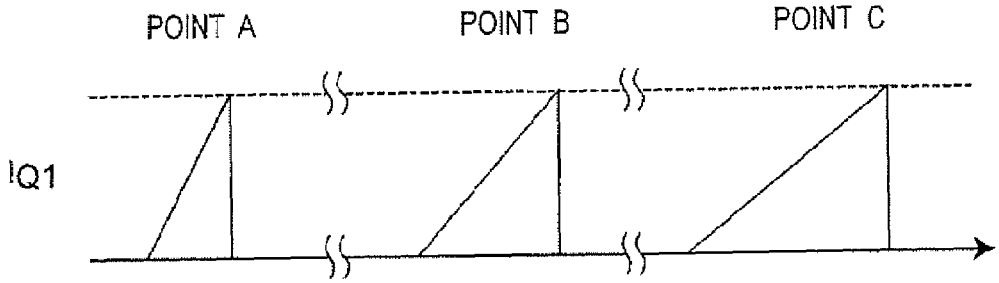
FIG. 3 is a waveform diagram which shows the waveform of a current in a switching element in the first embodiment of the present invention.
Figure 4:
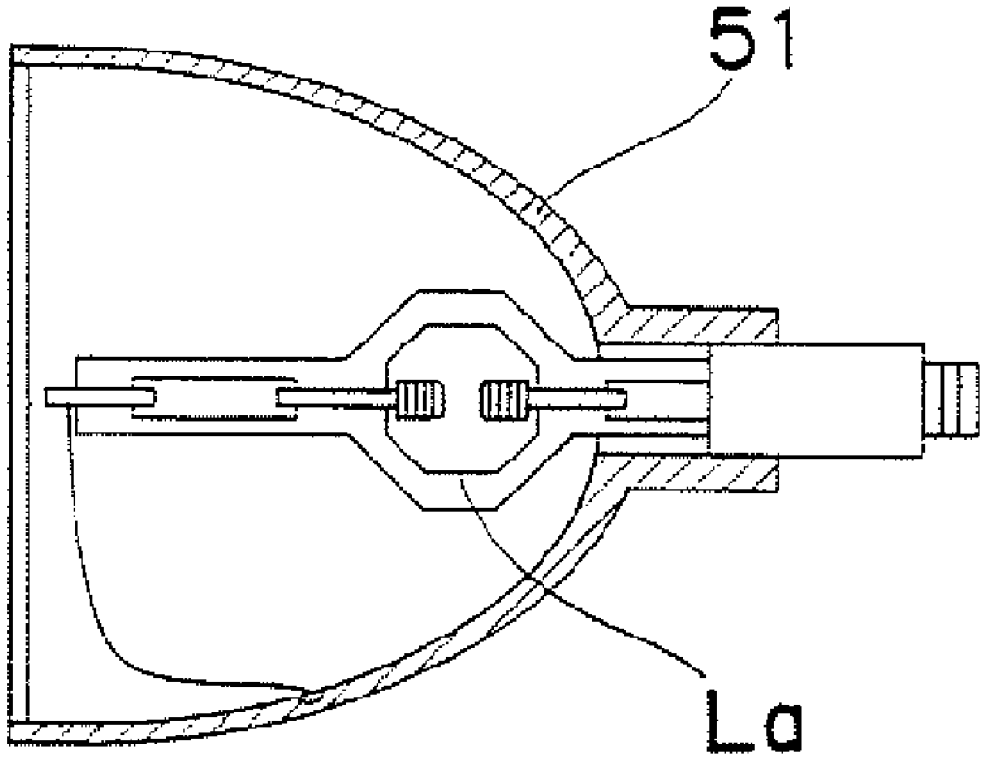
FIG. 4 is a drawing which shows the structure of a discharge lamp which is equipped with a reflection mirror.

A regular lighting operation of the discharge lamp lighting apparatus shown in FIG. 1 will now be described. FIG. 2 shows the detect voltage of a discharge lamp current and the reference voltage at points A, B and C on the d.c. voltage Vdc in the discharge lamp lighting apparatus according to this embodiment. The points A, B and C correspond respectively to the points A, B and C which are shown in FIG. 4. FIG. 3 shows a current IQ1 which flows in the switching element Q1 at the points A, B and C on the d.c. voltage Vdc in the discharge lamp lighting apparatus according to this embodiment.

The detect voltage shown in FIG. 2 is a voltage obtained by superimposing a power source ripple component divided by the resistors R2 and R3 over a detected value of the current IQ1 flowing in the switching element Q1 detected by the resistor R1. As shown in FIG. 2, VA1 is superimposed over the detected current IQ1 at the point A, VB1 is superimposed over the detected current IQ1 at the point B and VC1 is superimposed over the detected current IQ1 at the point C. Reflecting the d.c. voltage Vdc shown in FIG. 14, they hold the relationship of VA1>VB1>VC1.

The PWM control circuit 84 controls turning on and off of the switching element Q1 of the step-down chopper circuit 4 at a sufficiently higher frequency than the frequency (50 Hz or 60 Hz) of the commercial a.c. power source E. When the switching element Q1 is ON, the current IQ1 which flows in the resistor R1 is a gradually increasing current. While the switching element Q1 turns off when the voltage corresponding to this current detected by the resistor R1 exceeds the reference voltage, this control accompanies a predetermined delay time t1. The gradient of the gradually increasing current IQ1 is steeper at the point B than at the point C and at the point A than at the point B. Hence, although the gradually increasing current IQ1 is excessively large at the point A in the conventional structure as shown in FIG. 16, according to this embodiment, since the voltage VA1 superimposed over the detect voltage is large and the switching element Q1 turns off early, proper control is attained.

Figure 16:
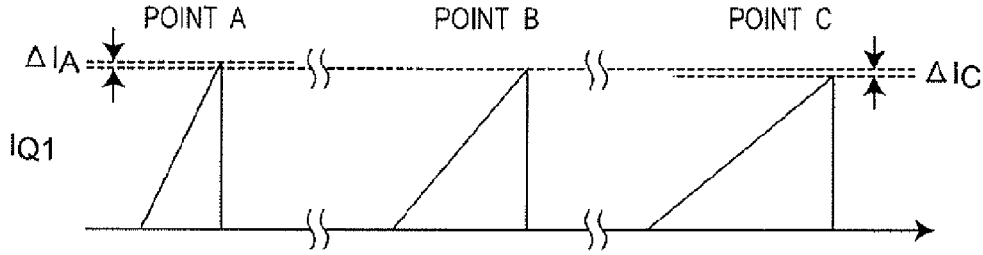
FIG. 16 is a waveform diagram which shows the waveform of a current in a switching element in the conventional example.

On the contrary, although the gradually increasing current IQ1 is excessively small at the point C within the conventional structure as shown in FIG. 16, according to this embodiment, since the voltage VC1 superimposed over the detect voltage is small and the switching element Q1 turns off late, proper control is attained.

In this manner, in the circuit shown in FIG. 1, superimposition of the power source ripple component obtained through division by the resistors R2 and R3 over the voltage detected by the resistor R1 realizes the operation above with a simple circuit structure. The resistor R1 is for current detection and therefore has a relatively low resistance value, while the resistors R2 and R3 which divide the d.c, voltage Vdc are for voltage detection and therefore have relatively high resistance values.

As the voltage detected by the power source ripple detecting circuit 9 is superimposed over the discharge lamp current detect voltage detected by the discharge lamp current detecting circuit 5 as shown in FIG. 2, it is possible to eliminate the influence of the gradient of the current IQ1 flowing through the switching element Q1 which is attributable to the delay time t1 in the PWM control circuit 84 and the ripple voltage in the d.c. voltage Vdc. This ensures that the current IQ1 which flows though the switching element Q1 has a constant peak value as shown in FIG. 3, the current ILa flowing through the discharge lamp La becomes constant and a desired characteristic is obtained.

With respect to the specification of the discharge lamp La to be lit up, the lamp ma be an a.c. lamp or a d.c. lamp. In the event that the discharge lamp La is an a.c. lamp, the invertor circuit 6 inverts the polarity of the lamp voltage at a low frequency, and the lamp is lit up with a rectangle wave. The inventor circuit 6 may be a full-bridge circuit or a half-bridge circuit. The importance is that the invertor circuit 6 has a function of inverting the polarity of the input d.c. voltage in predetermined cycles and outputting the same as an a.c. voltage.

Although the discharge lamp voltage detecting circuit 7 is connected so as to detect the output voltage from the invertor circuit 6 in the example shown in FIG. 1, the discharge lamp voltage detecting circuit 7 may be connected so that it detects the input voltage to the invertor circuit 6. In the event that the discharge lamp La is a d.c. lamp, the inventor circuit 6 is omitted and the output from the step-down chopper circuit 4 realizes d.c. lighting up of the discharge lamp La. In the case of either a d.c. lamp or an a.c. lamp, a smoothing capacitor may be connected in parallel with the output from the step-down chopper circuit 4. Further, the discharge lamp La to be lit up may be equipped with a reflection mirror 51 as shown in FIG. 4. These similarly apply to the embodiments described below as well.

Second Embodiment

Figure 5:
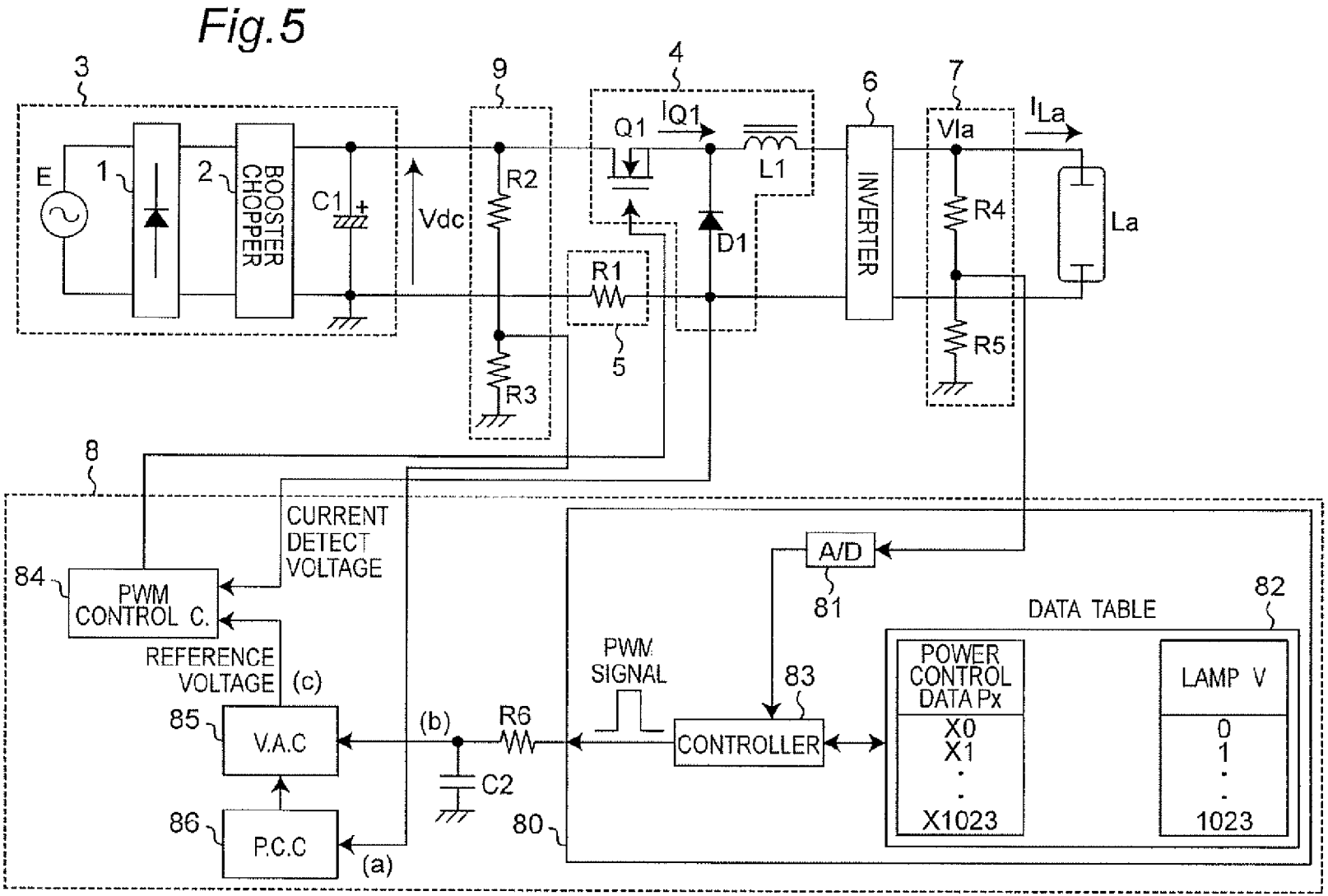
FIG. 5 is a circuitry diagram which shows a second embodiment of the present invention.

FIG. 5 is a circuitry diagram which shows the second embodiment of the present invention. The discharge lamp lighting apparatus according to this embodiment is different from the discharge lamp lighting apparatus according to the first embodiment shown in FIG. 1 with respect to the structures of the power source ripple detecting circuit 9 and the control circuit block 8.

The control circuit block 8 in the discharge lamp lighting apparatus according to this embodiment: includes the microcomputer 80, the PWM control circuit 84, a voltage addition circuit 85 and a phase control circuit 86.

The power source ripple detecting circuit 9 is formed by a series circuit of the resistor R2 and the resistor R3 which are connected between a high-voltage side output terminal and a low-voltage side output terminal of the d.c. power source section 3, and the control circuit block 8 directly receives a voltage which the resistor R2 and the resistor R3 generates by dividing the d.c. voltage Vdc.

The discharge lamp detect voltage which is detected by the discharge lamp voltage detecting circuit 7 is fed to the A/D conversion input port of the microcomputer 80 which is disposed within the control circuit block 8, and converted into a digital value by the build-in A/D convertor 81. The controller 83 refers to the data table 82, reads the power control data Px (X0, X1, . . . , X1023) corresponding to the lamp voltage data (0, 1, . . . , 1023) converted into a digital value, and outputs this as the PWM signal. A CR integrating circuit formed by the resistor R6 and the capacitor C2 averages out the PWM signal and feeds this to the voltage addition circuit 85. The phase control circuit 86 inverts the phase of the output of the power source ripple detecting circuit 9. The voltage addition circuit 85 adds the PWM signal thus averaged out to an output from the phase control circuit 86, and outputs this to the PWM control circuit 84 as the reference voltage (command value). The PWM control circuit 84 outputs a control signal based on the detect voltage and the reference voltage, controls the switching element Q1 of the step-down chopper circuit 4, and provides the discharge lamp La width power which meets the necessity.

Figure 6:
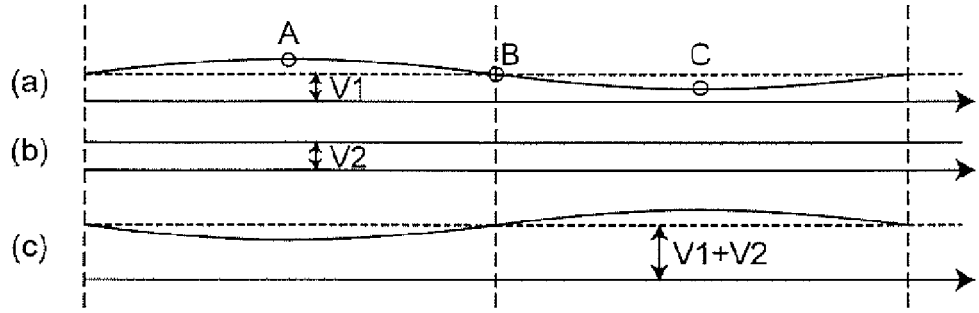
FIG. 6 is a waveform diagram which shows the waveform of a power source ripple detect voltage and that of an initial reference voltage and that of a reference voltage in the second embodiment of the present invention.
Figure 7:
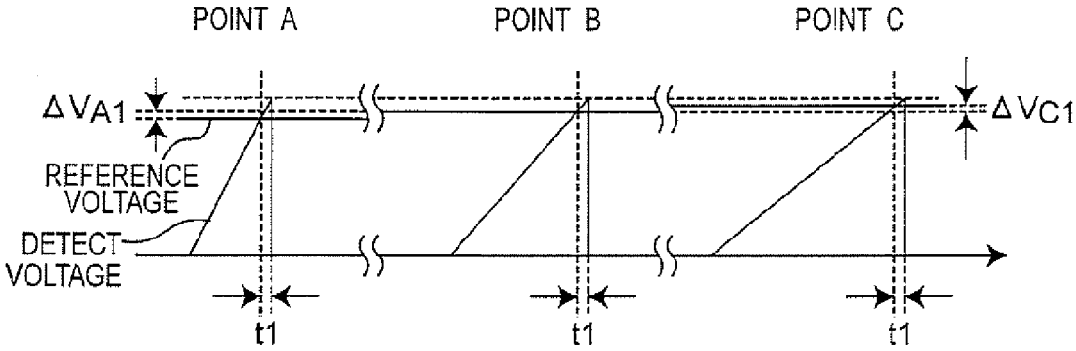
FIG. 7 is a waveform diagram which shows the waveform of a discharge lamp current detect voltage and that of a reference voltage in the second embodiment of the present invention.
Figure 8:
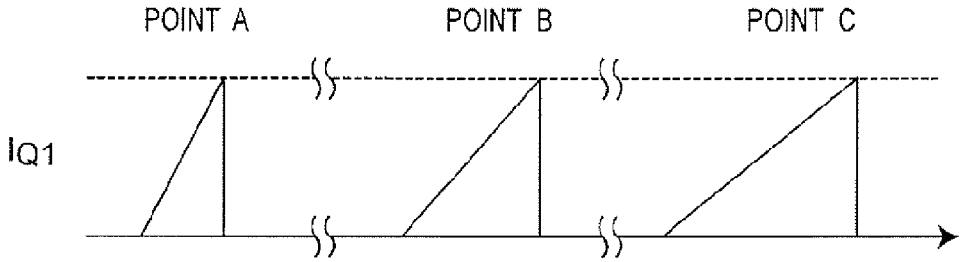
FIG. 8 is a waveform diagram which shows the waveform of a current in a switching element in the second embodiment of the present invention.
Figure 14:
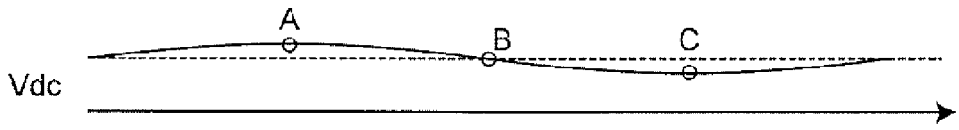
FIG. 14 is a waveform diagram which shows the waveform of power source voltage in the conventional example.

An operation of the lighting apparatus shown in FIG. 5 will now be described. FIG. 6(*a*) shows the power source ripple detect voltage detected by the power source ripple detecting circuit 9 and fed to the phase control circuit 86. FIG. 6(*b*) shows the initial reference voltage which is output from the microcomputer 80, averaged out by the CR integrating circuit and fed to the voltage addition circuit 85. FIG. 6(*c*) shows the reference voltage which is fed to the PWM control circuit 84 after the opposite phase of the power source ripple detect voltage is superimposed over the reference voltage. FIG. 7 shows the discharge lamp current detect voltage and the reference voltage at points A, B and C on the d.c. voltage Vdc in the discharge lamp lighting apparatus according to this embodiment. The points A, B and C correspond respectively to the points A, B and C which are shown in FIG. 14. FIG. 8 shows the current IQ1 which flows in the switching element Q1 at the points A, B and C on the d.c. voltage Vdc in the discharge lamp lighting apparatus according to this embodiment.

Figure 15:
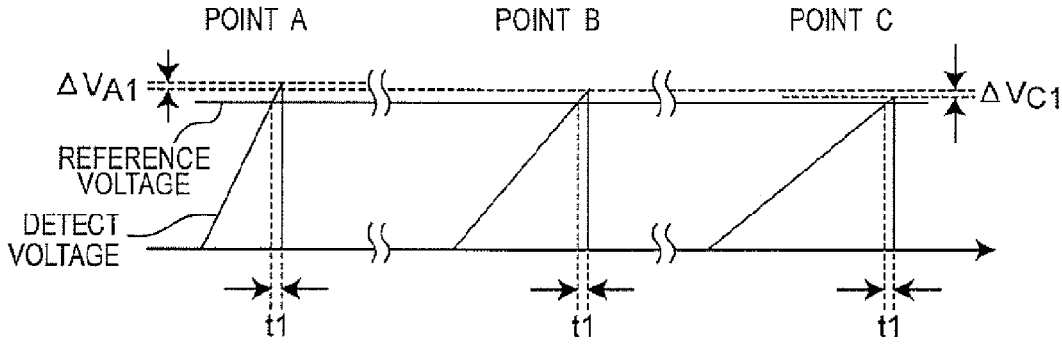
FIG. 15 is a waveform diagram which shows the waveform of a discharge lamp current detect voltage and that of a reference voltage in the conventional example.

As described earlier in relation to the background art, the conventional structure has a problem that the detect voltage at the point A exceeds that at the point B by ΔVA1 but becomes lower by ΔVC1 at the point C than at the point B as shown in FIG. 15. On tile contrary, according to this embodiment, as shown in FIG. 7, at the point A, the reference voltage (solid line) is set lower by ΔVA1 than at the point B, and at the point C, the reference voltage (solid line) is set higher by ΔVC1 than at the point B.

In this fashion, the phase control circuit 86 inverts the power source ripple detect voltage (FIG. 6(*a*)) detected by the power source ripple detecting circuit 9 into the voltage having the opposite phase and this opposite-phase voltage is superimposed over the initial reference voltage (FIG. 6(*b*)) which is output from the microcomputer 80, thereby setting the reference voltage (FIG. 6(*c*)). This eliminates the influence of the gradient of the current IQ1 flowing through the switching element Q1 which is attributable to the delay time t1 in the PWM control circuit 84 and the ripple voltage contained in the d.c. voltage Vdc as shown in FIG. 7, and ensures that the current IQ1 which flows through the switching element Q1 has a constant peak value as shown in FIG. 8. As a result the current ILa flowing through the discharge lamp La becomes constant and a desired characteristic is obtained.

Third Embodiment

Figure 9:
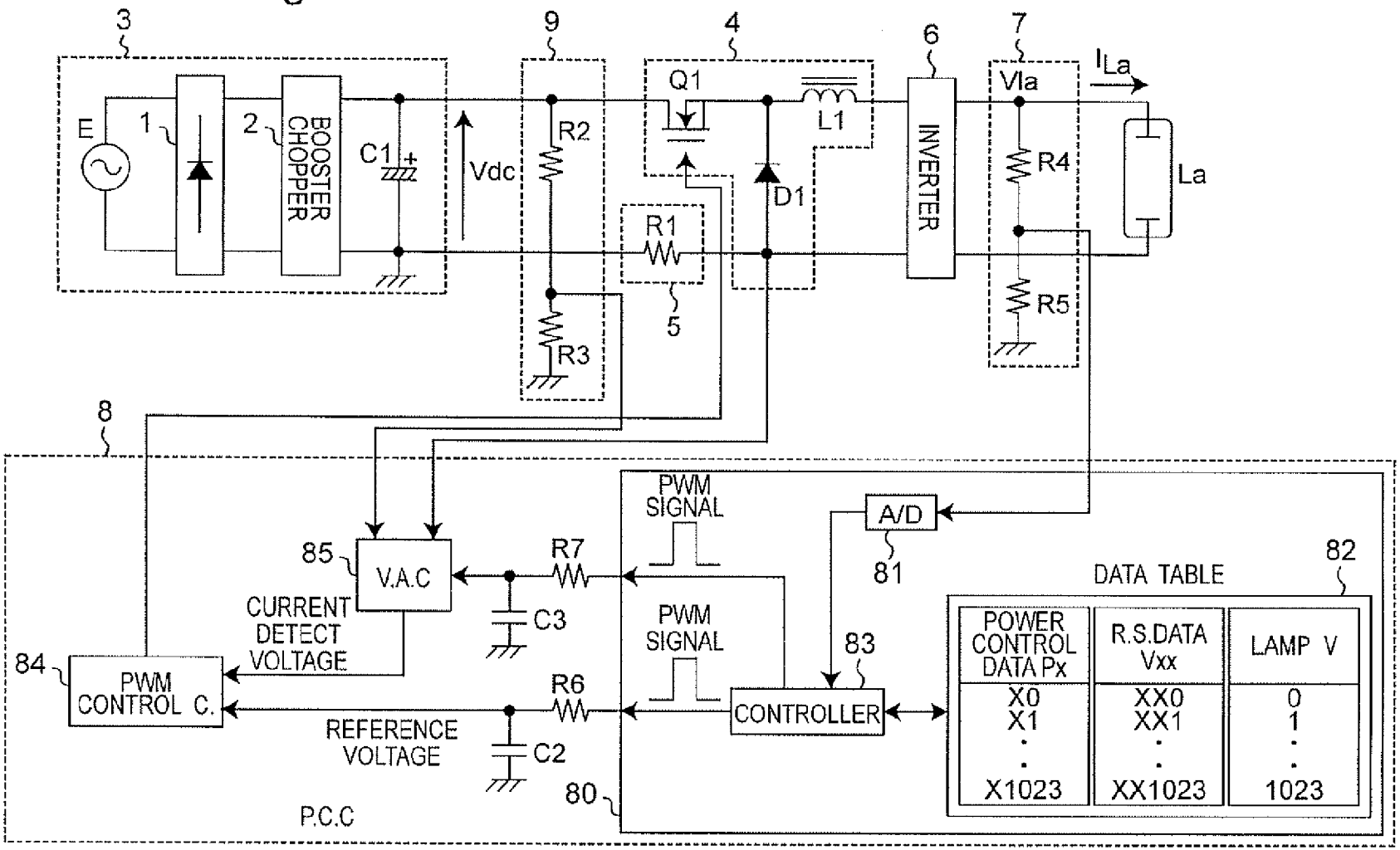
FIG. 9 is a circuitry diagram which shows a third embodiment of the present invention.

FIG. 9 is a circuitry diagram which shows the third embodiment of the present invention. This embodiment demands control for switching a rate of superimposition of the detect voltage of power in accordance with the discharge lamp voltage. The discharge lamp lighting apparatus according to this embodiment is different from the discharge lamp lighting apparatus according to the second embodiment in terms of the structure of the control circuit block 8. The control circuit block 8 according to this embodiment includes the microcomputer 80, the PWM control circuit 84 and the voltage addition circuit 85.

In the data table 82 inside the microcomputer 80, the discharge lamp voltage, the lighting power Px and voltage ripple superimposition data Vxx are stored in correlation to each other. In the data table 82, the power control data Px is a power control data command value (X0, X1, . . . , X1023) in response to the detected lamp voltage value (0, 1, . . . , 1023). The ripple superimposition data Vxx is a ripple superimposition data command value (XX0, XX1, . . . , 1023) in response to the detected lamp voltage value (0, 1, . . . , 1023). According to the data table 82, when the detected lamp voltage value is n, the power control data command value is Xn and the ripple superimposition data command value is XXn.

The discharge lamp detect voltage which is detected by the discharge lamp voltage detecting circuit 7 is fed to the A/D conversion input port of the microcomputer 80 which is disposed within the control circuit block 8, and converted into a digital value by the build-in A/D convertor 81. The controller 83 refers to the data table 82, reads the power control data Px (X0, X1, . . . , X1023) corresponding to the lamp voltage data (0, 1, . . . , 1023) converted into a digital value, and outputs this as the PWM signal. A CR integrating circuit formed by the resistor R6 and the capacitor C2 averages out the PWM signal and transmits this to the PWM control circuit 84 as the reference voltage (command value). The step-down chopper circuit 4 provides the discharge lamp La with power which meets the necessity, in accordance with the control signal received from the PWM control circuit 84.

The controller 83 further refers to the data table 82, reads the ripple superimposition data (XX0, XX1, . . . , XX1023) corresponding to the lamp voltage data (0, 1, . . . , 1023), and outputs this as the PWM signal. A CR integrating circuit formed by a resistor R7 and a capacitor C3 averages out the PWM signal, and feeds this to the voltage addition circuit 85 as superimposition rate data.

The voltage addition circuit 85 superimposes the power source ripple component of the d.c. voltage Vdc from the d.c. power source section 3 which is detected by the power source ripple detecting circuit 9 over the discharge lamp current detect voltage detected by the discharge lamp current detecting circuit 5. The voltage addition circuit 85 switches the rate of superimposition based on the electric potential of the capacitor C3. This eliminates the influence of the gradient of the current IQ1 flowing through the switching element Q1 which is attributable to the delay time t1 in the PWM control circuit 84 and the ripple voltage contained in the d.c. voltage Vdc, ensures that the current IQ1 which flows through the switching element Q1 has a constant peak value. As a result, the current ILa flowing through the discharge lamp La becomes constant and a desired characteristic is obtained. In this embodiment, the detected lamp voltage value matches with the power control data Px in the data table 82, which per se realizes control of switching the rate of superimposition of the detect voltage from the power source in accordance with the power supplied to the discharge lamp.

Fourth Embodiment

Figure 10:
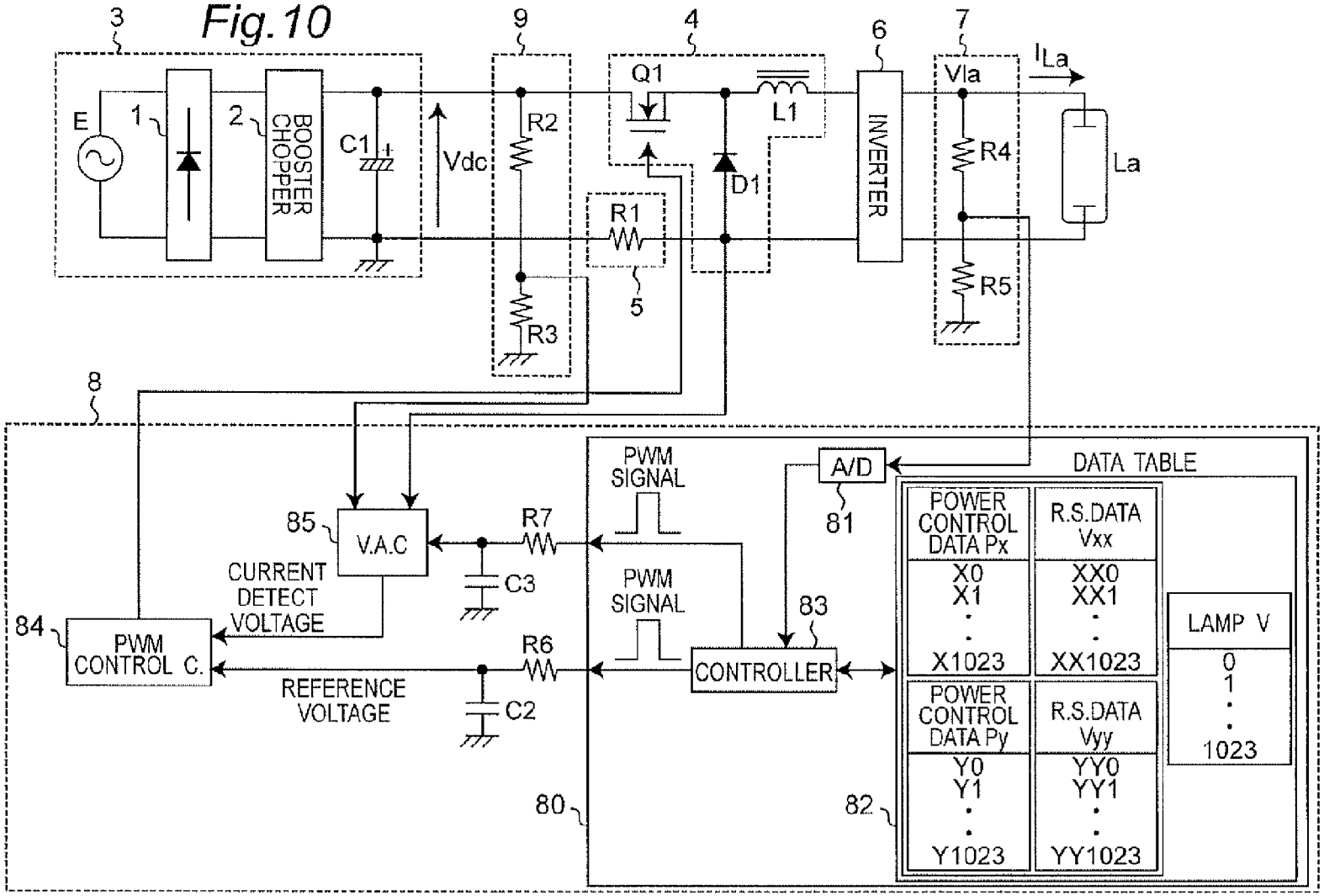
FIG. 10 is a circuitry diagram which shows a fourth embodiment of the present invention.

FIG. 10 is a circuitry diagram which shows the fourth embodiment of the present invention. The discharge lamp lighting apparatus according to this embodiment is different from the discharge lamp lighting apparatus according to the third embodiment in terms of the content of the data table 82. That is, in the discharge lamp lighting apparatus according to this embodiment, as shown in FIG. 10, a discharge lamp voltage-discharge lamp power-voltage ripple superimposition data table is prepared for each one of different lamp types inside the data table 82. This permits dealing with plural different types of lamps.

In FIG. 10, the power control data Px is the power control data command value (X0, X1, . . . , X1023) in response to the detected lamp voltage value (0, 1, . . . , 1023) for a first lamp type. The ripple superimposition data Vxx is the ripple superimposition data command value (XX0, XX1, . . . , XX1023) in response to the detected lamp voltage value (0, 1, . . . , 1023) for the first lamp type.

In a similar manner, power control data Py and ripple superimposition data Vyy are respectively a power control data command value (Y0, Y1, . . . , Y1023) and a ripple superimposition data command value (YY0, YY1, . . . YY1023) in response to the detected lamp voltage value (0, 1, . . . , 1023) for a second lamp type.

A signal for specifying the type of the lamp may be set utilizing the state (High level or Low level) of any input port of the microcomputer 80. The microcomputer 80, owing to how its input port is set or by means of detection of a change of the lamp voltage Vla with time after power-on, recognizes the type of the lamp La and selects the associated table data.

Hence, despite a different lamp type, it is possible to eliminate the influence of the gradient of the current IQ1 flowing through the switching element Q1 which is attributable to the delay time t1 in the PWM control circuit 84 and the ripple voltage contained in the d.c. voltage Vdc and ensure that the current IQ1 which flows through the switching element Q1 has a constant peak value. The current ILa flowing through the discharge lamp La therefore becomes constant and a desired characteristic is obtained. In the third or the fourth embodiment as well, the power source ripple component may be superimposed over the reference voltage instead of superimposing the same over the detect voltage as described earlier in relation to the second embodiment.

Fifth Embodiment

Figure 11:
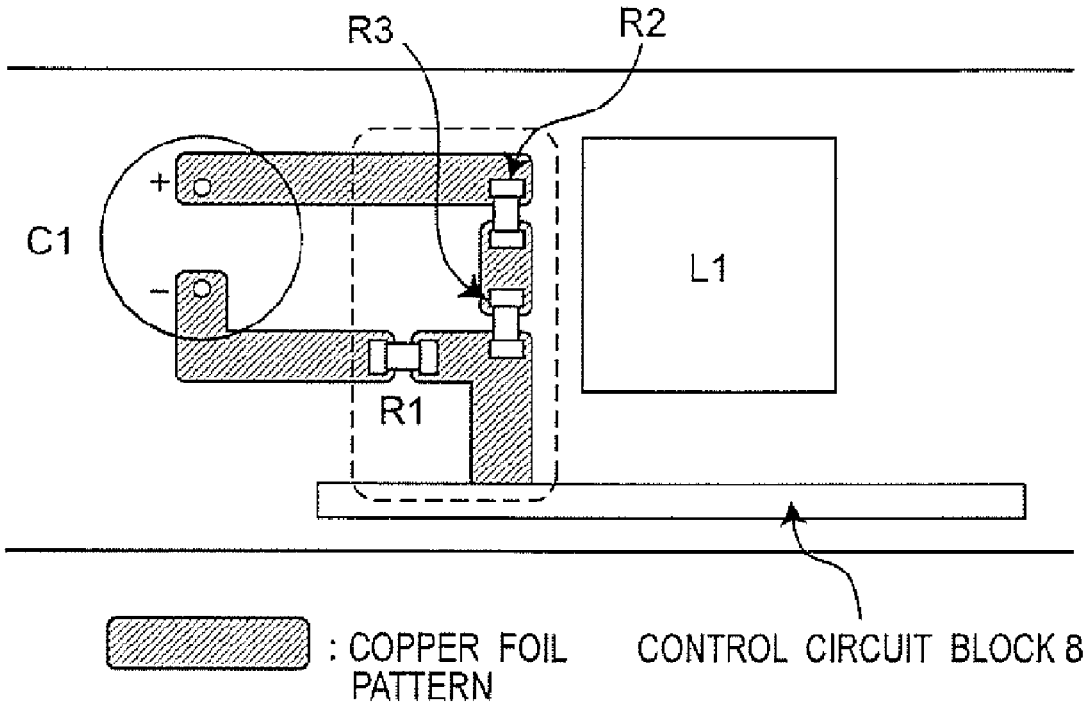
FIG. 11 is a plan view which shows an essential part according to a fifth embodiment of the present invention.

FIG. 11 is a plan view which shows an essential part according to the fifth embodiment of the present invention, and illustrates a circuit pattern of a printed circuit board around the smoothing capacitor C1 and the inductor L1. This embodiment avoids disposing a detecting circuit pattern for power source detection under a coil which operates at a high frequency during a regular operation. In FIG. 11, components R1, R2 and R3 of the circuit pattern enclosed by the broken line correspond to the resistors R1, R2 and R3 described earlier. The components R1, R2 and R3 are disposed on the side of the chopper inductor (coil) L1 which operates at a high frequency during a regular operation, but not under the chopper inductor (coil) L1. This prevents superimposition of a high-frequency noise during voltage ripple detection and hence, further obviates a flicker.

Sixth Embodiment

Figure 12A:
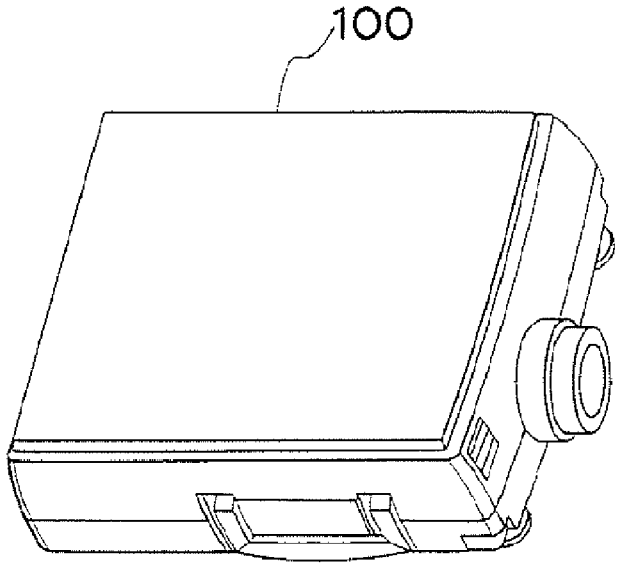
FIG. 12A is a perspective view of a projector according to the present invention.
Figure 12B:
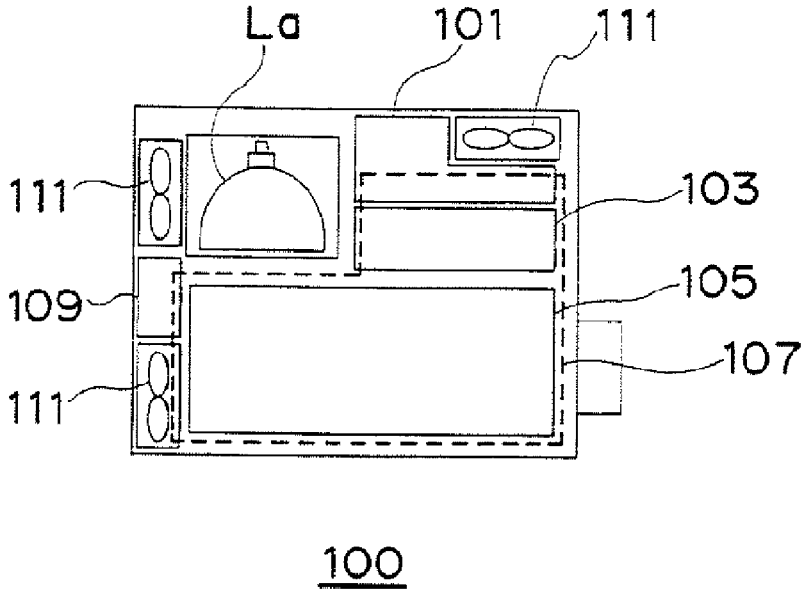
FIG. 12B is a drawing which shows the internal structure of the projector according to the present invention.
Figure 13:
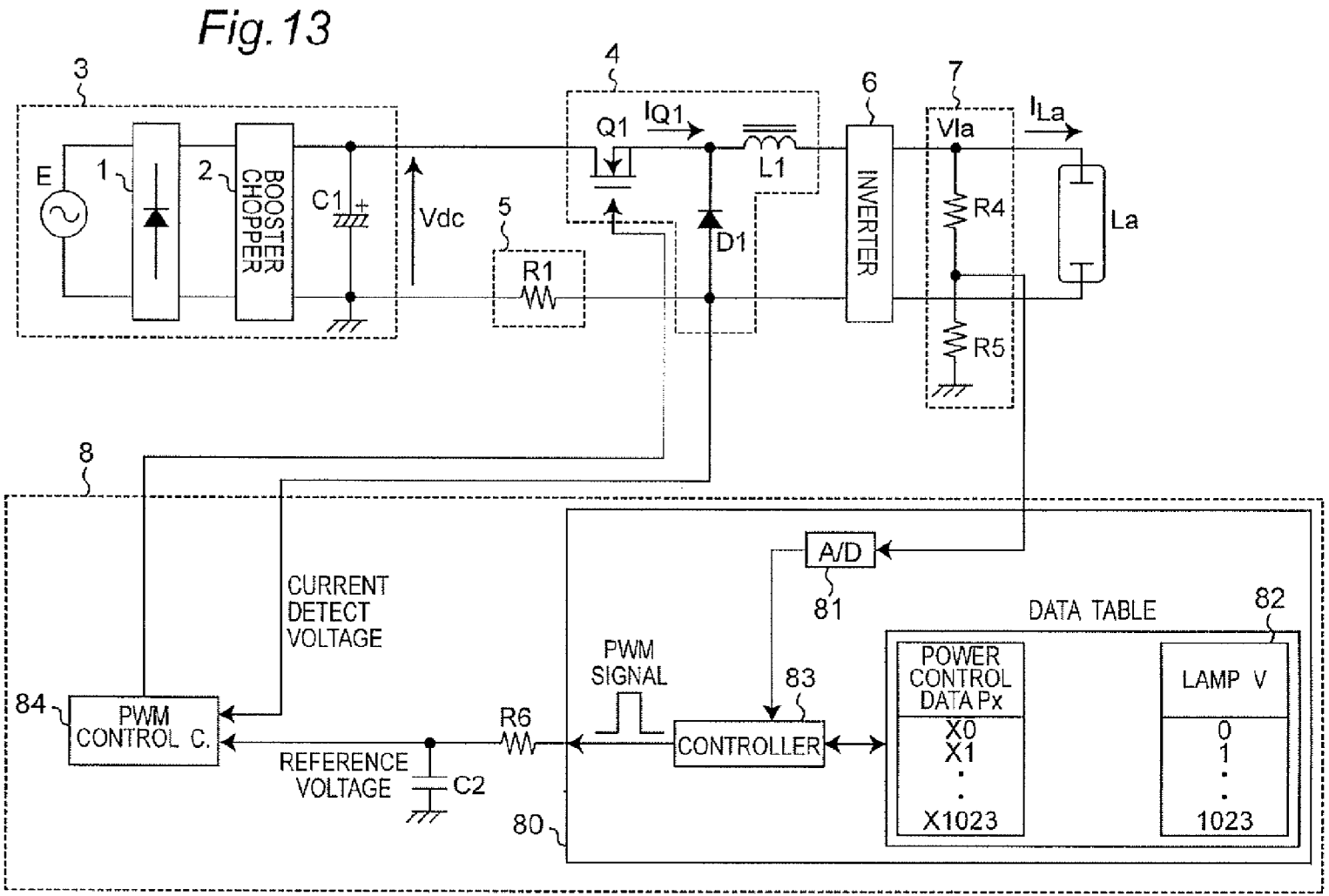
FIG. 13 is a circuitry diagram which shows a conventional example.

An application of the discharge lamp lighting apparatus according to the embodiments above to a protector will now be described with reference to FIG. 12A and FIG. 12B FIG. 12A is a perspective view of a projector comprising the discharge lamp lighting apparatus according to the embodiments above, and FIG. 12B is a drawing which shows the internal structure of this projector. As shown in FIG. 12B, the projector 100 includes a power source section 101, a discharge lamp lighting apparatus 103, an optical system 105, a main control substrate 107, an external signal input part 109, a cooling fan 111, and the discharge lamp La. The discharge lamp lighting apparatus 103 is the lighting apparatus (exclusive of the d.c. power source section 3) described in relation to each embodiment above. Circuit components and the like are mounted for image signal processing on the main control substrate 107.

A video signal and an image signal are fed from outside via the external signal input section 109. The discharge lamp lighting apparatus 103 is provided with d.c. power from the power source section 101. The discharge lamp lighting apparatus 103 lights up the discharge lamp La. Light from the discharge lamp La is output to outside via the optical system 105 in accordance with a video signal and an image signal received from outside.

The discharge lamp lighting apparatus according to each embodiment above is applicable not only to a projector but also to an inspection light source as an illumination apparatus which reduces a flicker, etc.

While the foregoing has described the invention in relation to the specific embodiments, those skilled in the art may clearly modify, change or otherwise utilize the invention in numerous fashions. The present invention is therefore not limited to the particular disclosure provided herein but rather may be restricted merely by the attached claims. This application is relevant to the Japanese patent application No. 2004-173154 (filed on Jun. 10, 2004), which disclosure is herein incorporated by reference.

The invention claimed is:

1. A discharge lamp lighting apparatus which lights up a discharge lamp, comprising:

a d.c. power source section which rectifies and smoothes an a.c. voltage and outputs a d.c. voltage;

a discharge lamp current detecting circuit which detects a current which flows through said discharge lamp;

a discharge lamp voltage detecting circuit which detects a voltage applied upon said discharge lamp;

a power source ripple detecting circuit which detects a voltage change of power supplied from said d.c. power source section; and a control circuit which compares a detected voltage which is available from said discharge lamp current detecting circuit with a reference voltage and controls the discharge lamp current so that the discharge lamp current becomes a current corresponding to the reference voltage, wherein said control circuit generates the reference voltage based on the discharge lamp detect voltage detected by said discharge lamp voltage detecting circuit, superimposes the detected voltage change by the power source ripple detecting circuit over the detected voltage which is available from said discharge lamp current detecting circuit, and controls, based on said superimposed voltage change and said reference voltage, an output voltage to said discharge lamp so that said current flowing through said discharge lamp becomes a constant current.

2. The discharge lamp lighting apparatus of claim 1, wherein a rate of superimposition of said output voltage from said power source ripple detecting circuit is switched in accordance with a discharge lamp voltage.

3. The discharge lamp lighting apparatus of claim 1, wherein a rate of superimposition of said output voltage from said power source ripple detecting circuit is switched in accordance with power which is supplied to said discharge lamp.

4. The discharge lamp lighting apparatus of claim 1, wherein a rate of superimposition of said output voltage from said power source ripple detecting circuit is switched in accordance with the type of said discharge lamp.

5. The discharge lamp lighting apparatus of claim 1, wherein a circuit component for detecting a voltage change of an output from said d.c. power source section is not disposed under a coil which operates at a high frequency during a regular operation.

6. The discharge lamp lighting apparatus of claim 1, wherein said discharge lamp is an a.c. lamp.

7. The discharge lamp lighting apparatus of claim 1, wherein said discharge lamp is a d.c. lamp.

8. The discharge lamp lighting apparatus of claim 1 wherein said discharge lamp comprises a reflection mirror.

9. A projector, comprising:

a discharge lamp which serves as a light source; and the discharge lamp lighting apparatus of claim 1 which lights up said discharge lamp.

10. A discharge lamp lighting apparatus which lights up a discharge lamp, comprising:

a d.c. power source section which rectifies and smoothes an a.c. voltage and outputs a d.c. voltage;

a discharge lamp current detecting circuit which detects a current which flows through said discharge lamp;

a discharge lamp voltage detecting circuit which detects a voltage applied upon said discharge lamp;

a power source ripple detecting circuit which detects a voltage change of power supplied from said d.c. power source section; and a control circuit which compares a detected voltage which is available from said discharge lamp current detecting circuit with a reference voltage and controls the discharge lamp current so that the discharge lamp current becomes a current corresponding to the reference voltage, wherein said control circuit generates a pulse width modulation (PWM) signal based on the discharge lamp detect voltage detected by said discharge lamp voltage detecting circuit, superimposes a voltage having an opposite phase of an output voltage from said power source ripple detecting circuit over the PWM signal to generate the reference voltage, and controls, based on thus generated reference voltage and the detected voltage which is available from said discharge lamp current detecting circuit, an output voltage to said discharge lamp so that a current flowing through said discharge lamp becomes a constant current.

11. The discharge lamp lighting apparatus of claim 10, wherein a rate of superimposition of said output voltage from said power source ripple detecting circuit is switched in accordance with a discharge lamp voltage.

12. The discharge lamp lighting apparatus of claim 10, wherein a rate of superimposition of said output voltage from said power source ripple detecting circuit is switched in accordance with power which is supplied to said discharge lamp.

13. The discharge lamp lighting apparatus of claim 10, wherein a rate of superimposition of said output voltage from said power source ripple detecting circuit is switched in accordance with the type of said discharge lamp.

14. The discharge lamp lighting apparatus of claim 10, wherein a circuit component for detecting a voltage change of an output from said d.c. power source section is not disposed under a coil which operates at a high frequency during a regular operation.

15. The discharge lamp lighting apparatus of claim 10, wherein said discharge lamp is an a.c. lamp.

16. The discharge lamp lighting apparatus of claim 10, wherein said discharge lamp is a d.c. lamp.

17. The discharge lamp lighting apparatus of claim 10, wherein said discharge lamp comprises a reflection mirror.

18. A projector, comprising:

a discharge lamp which serves a light source; and the discharge lamp lighting apparatus of claim 10 which lights up said discharge lamp.

* * * * *